United States Patent [19]

Wesson et al.

[11] Patent Number: 4,836,109

[45] Date of Patent: Jun. 6, 1989

[54] CONTROL LINE DIFFERENTIAL FIRING HEAD

[75] Inventors: David S. Wesson, Katy; Kevin R. George, Columbus, both of Tex.

[73] Assignee: Halliburton Company, Duncan, Okla.

[21] Appl. No.: 248,329

[22] Filed: Sep. 20, 1988

[51] Int. Cl.[4] ..... F42B 3/12

[52] U.S. Cl. ..... 102/312; 102/205; 102/216; 102/275.7; 102/275.8

[58] Field of Search ..... 102/312, 205, 216, 275.7, 102/275.8; 175/4.57

[56] References Cited

U.S. PATENT DOCUMENTS

| | | | |
|---|---|---|---|
| 4,273,047 | 6/1981 | Rommer | 102/310 |
| 4,484,632 | 11/1984 | Vann | 166/297 |
| 4,509,604 | 4/1985 | Upchurch | 175/4.52 |
| 4,523,643 | 6/1985 | McGlothen | 166/297 |
| 4,544,034 | 10/1985 | George | 166/297 |
| 4,560,000 | 12/1985 | Upchurch | 166/55.1 |
| 4,564,076 | 1/1986 | Vann et al. | 175/4.52 |
| 4,614,156 | 9/1986 | Colle, Jr. et al. | 102/312 |
| 4,616,566 | 10/1986 | Yates, Jr. | 102/318 |
| 4,632,034 | 12/1986 | Colle, Jr. | 102/312 |
| 4,655,298 | 4/1987 | George et al. | 175/4.52 |
| 4,753,170 | 6/1988 | Regalbuto et al. | 102/305 |

OTHER PUBLICATIONS

Vannsystems Equipment—"Time Delay Firing Head", (1987).

Vannsystems Equipment—"Annulus Pressure Firing Head", (1987).

Vannsystems Equipment Firer—"Releasable Annulus Pressure Firer", (1987).

Vannsystems Equipment—"Pressure Actuated Firing Head", (1987).

*Primary Examiner*—Peter A. Nelson

*Attorney, Agent, or Firm*—Arnold, White & Durkee

[57] ABSTRACT

A firing head assembly for a well bore perforating gun in which alternative firing paths are provided. A first detonation cord passes longitudinally through a generally cylindrical housing, providing a firing path from a firing head above the housing to a perforating gun below the housing. A firing pin and second detonation cord are located in the housing and are positioned radially offset from the longitudinal axis of the housing. Boosters on the first and second detonation cords are positioned adjacent one another and opposite a third booster. Either or both of the first and second boosters may be used to fire the third booster. No splicing of detonation cords is required and the detonation cords are completely contained within a protective housing. The firing pin may be actuated by pressure or mechanical means.

6 Claims, 3 Drawing Sheets

Fig. 1C
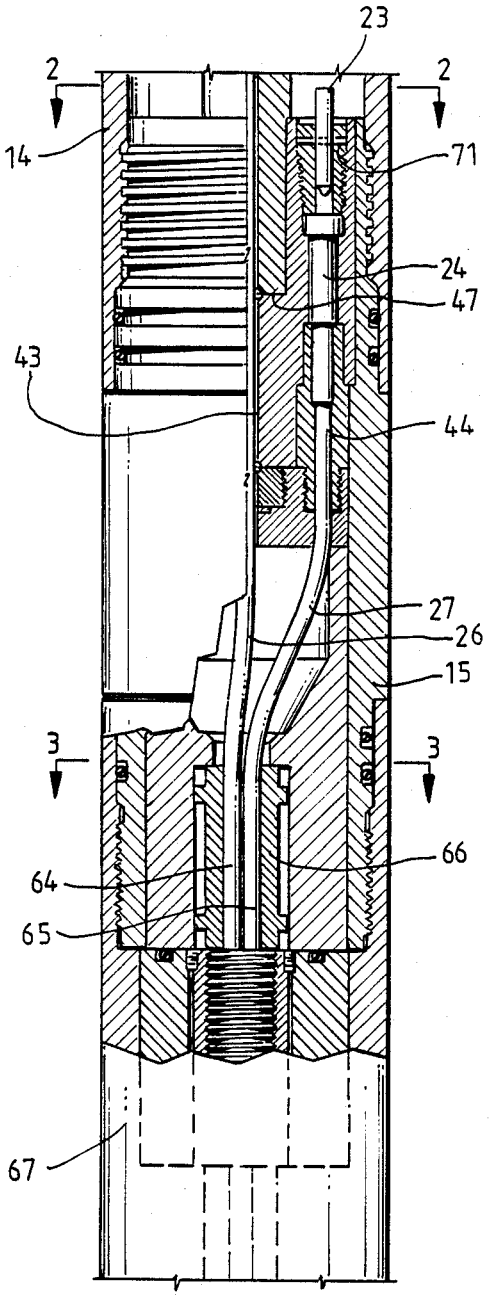
Fig. 2
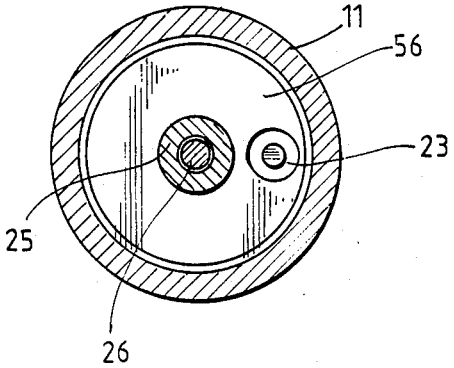
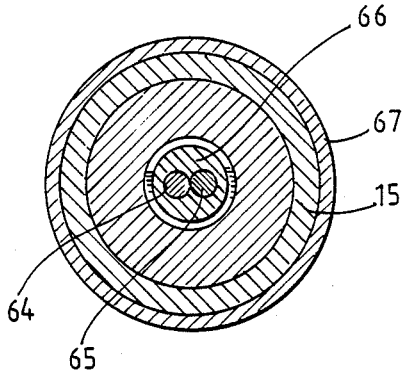
Fig. 3

Fig. 4B
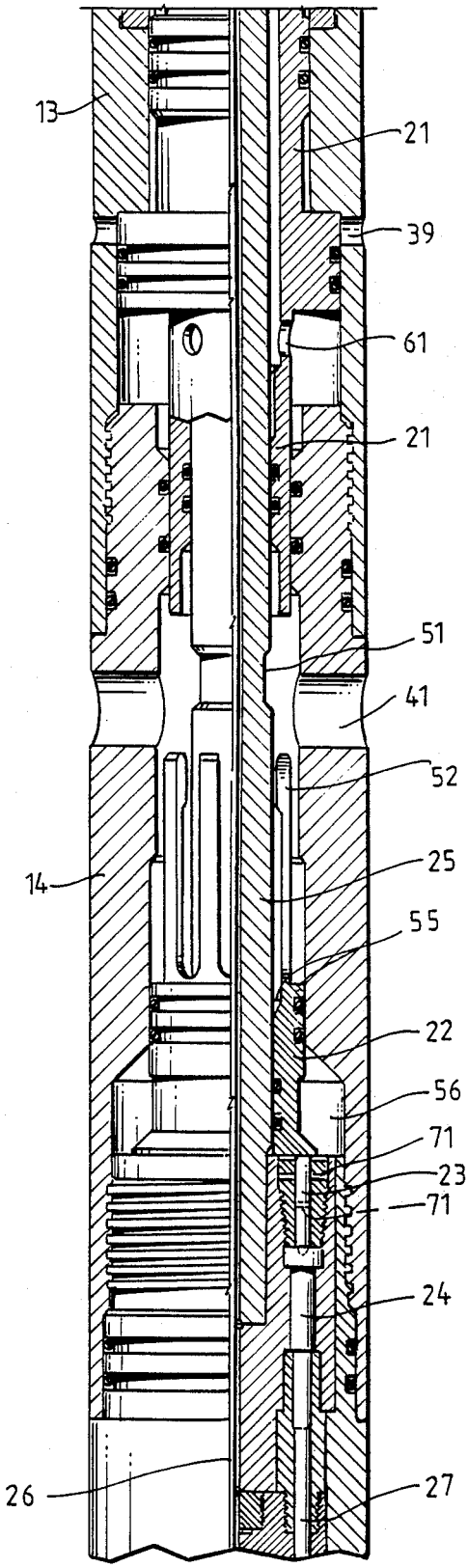
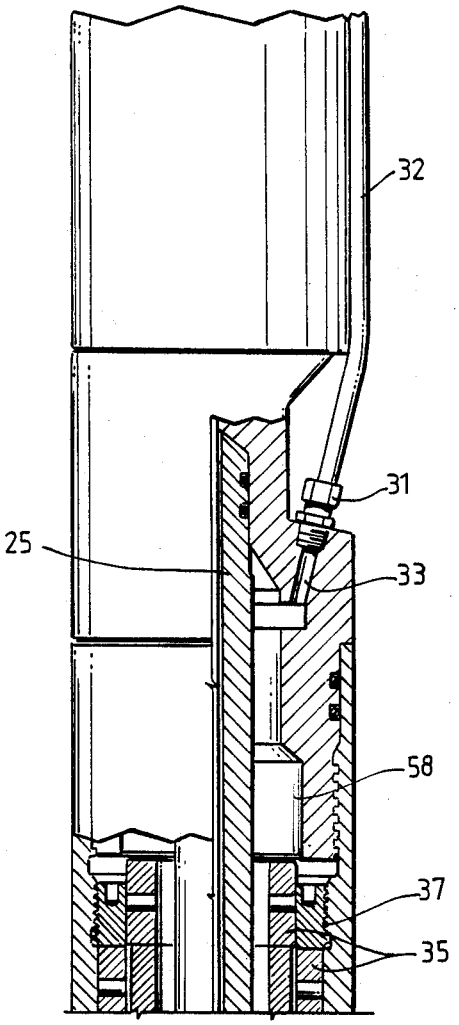
Fig. 4A

CONTROL LINE DIFFERENTIAL FIRING HEAD

This is a continuation of co-pending application Ser. No. 186,906, filed on Apr. 27, 1988, now abandoned.

FIELD OF THE INVENTION

The present invention relates to a perforation gun firing head which is actuated by means of a differential pressure existing between a control line and the rathole. The present invention also relates to an apparatus for accommodating redundant firing heads with a single tubing-conveyed perforating gun through use of a firing mechanism which is spaced radially from the longitudinal axis of the firing head housing.

BACKGROUND OF THE INVENTION

Multiple firing heads have been used on a single well bore perforating gun for the purpose of providing redundancy in the event of one firing head failing to operate properly. Various configurations have been used to connect the multiple firing heads to the single gun, including the placement of a single firing head on each end of the perforating gun. Another configuration involves the placement of two firing heads, in line, on one end of the perforating gun between the gun and the tubing. The two firing heads are typically operable by different means, for example, tubing pressure, annulus pressure, hydraulic control lines, and mechanical means such as a "go devil". Various differential pressure schemes have also been utilized.

The use of redundant top-fired heads for tubing-conveyed perforating guns often requires the splicing of detonation cords and the routing of one detonation cord from an upper firing head around a lower head through an annular space or otherwise radially offset from the center of the string. The types of detonation transfers which are required and the round-about routing of a detonation cord results in significant unreliability of the redundant system, thereby limiting its usefulness.

SUMMARY OF THE INVENTION

A well-bore perforating firing head according to the present invention includes a firing mechanism housed in a generally cylindrical housing. The firing mechanism, which includes a first detonation cord, is not located along the longitudinal axis of the housing, but rather is spaced radially from the axis. By locating the firing mechanism radially from the longitudinal axis of the housing, a second detonation cord may be passed straight through the housing, thus providing redundant firing paths without the normally-attendant detonation cord routing problems. The two detonation cords terminate in boosters which are positioned adjacent one another and which are each aimed at a third booster. This third booster is actuable by either or both of the first and second boosters. The first and second detonation cords need not be spliced or joined together in a single booster.

When used in conjunction with other firing heads for redundancy, the firing head of the present invention overcomes the disadvantages of prior devices by providing extremely reliable detonation transfers and relatively simple assembly. Rather than passing a detonation cord around a entire tool, the initiator in the present head is offset. Only a short detonation cord from this initiator is offset and it is completely enclosed in the housing. A detonation cord passage is provided along the longitudinal axis of the firing head which will accommodate a straight-through passage of a detonation cord from a firing head above.

In one embodiment, the firing head is actuated by the movement of an actuating piston and a firing piston. The pressure in a control line acts in differential with another pressure, for example, lower well bore annulus, to move the actuating piston, releasing the firing piston so that it can be actuated. The lower well bore annulus pressure then acts on the firing piston to drive it into a firing pin. This impact causes the guns to fire. If the firing head fails to operate for any reason, another firing head may be actuated to utilize the straight-through detonation cord and fire the guns.

One embodiment of the present invention includes a cylindrical firing head housing having an actuating piston and a firing piston slidable therein. A detonation cord tube is situated within the bore of the housing and lies along the longitudinal axis of the housing. The tube receives a first, straight-through detonation cord which generally will include a booster on each end. An annular space is formed between the detonation cord tube and the housing. Slidable in the annular space is a sleeve-like actuation piston and a sleeve-like firing piston. The firing piston includes collet fingers which engage a circumferential groove in the detonation cord tube. The actuation piston is slidable over the collet fingers to maintain the fingers in engagement with the groove.

The actuation piston is moveable from a first position, wherein it engages the collet fingers and maintains them in engagement with the circumferential groove, to a second position, wherein the actuation piston releases the collet fingers from the groove, allowing the firing piston to slide longitudinally with respect to the detonation cord tube and the housing. The actuation piston is held in its first position by means of a shear pin set that engages the housing and the actuation piston.

The actuation piston and the firing piston divide the annular space into three annular regions. A first annular region is in fluid communication with the well bore annulus. A second annular region is in fluid communication with the hydraulic control line. A third annular region is also in fluid communication with the well bore annulus.

A firing pin is located proximate the firing piston and is held stationary by means of a shear pin. The firing pin is offset radially from the longitudinal axis of the housing and is adjacent a detonator and short detonation cord, the detonation cord having a booster on each of its ends. The straight-through detonation cord and the short detonation cord terminate in boosters which are positioned adjacent one another. A third booster is positioned opposite the first two boosters so as to be actuable by either or both of the first two.

One embodiment of the present invention operates as follows: the hydraulic control line and the well bore annulus, through communication with the second and third annular regions, respectively, provide a differential pressure acting upon the actuation piston. When the control line pressure exceeds the well bore annulus pressure by a predetermined amount, the shear pin set fails and the actuation piston is moved from its first position to its second position, releasing the collet fingers of the firing piston from the circumferential groove in the detonation cord tube. Through fluid communication with the first annular region, the well bore annulus pressure forces the firing piston into contact with the firing pin, causing detonation of the detonator. In the event of a failure within the hydraulically actuated firing system, a second firing head, in conjunction with the straight-through detonation cord, may be actuated using a variety of means, for example, a "go devil" or tubing pressure.

BRIEF DESCRIPTION OF THE DRAWINGS

FIGS. 1A, 1B and 1C show a partial cutaway, partial section elevation view of a firing head of the present invention in its unactuated position.

FIG. 2 shows a cross-section taken through the line 2—2 in FIG. 1C.

FIG. 3 shows a cross-section taken through the line 3—3 in FIG. 1C.

FIGS. 4A and 4B show a partial cutaway, partial section elevation view of the firing head in its actuated position.

DETAILED DESCRIPTION OF A PREFERRED EMBODIMENT

A firing head according to the present invention is used in conjunction with a tubing string, well bore packer, and tubing-conveyed perforating gun in much the same manner as other firing heads. The firing head is placed in the tubing string between the packer and the perforating gun and a hydraulic control line extends between the packer and the firing head. A second firing head may be included above the firing head of the present invention for redundancy and may be actuable by a variety of methods, including pressure or mechanical means.

Figure 1A:
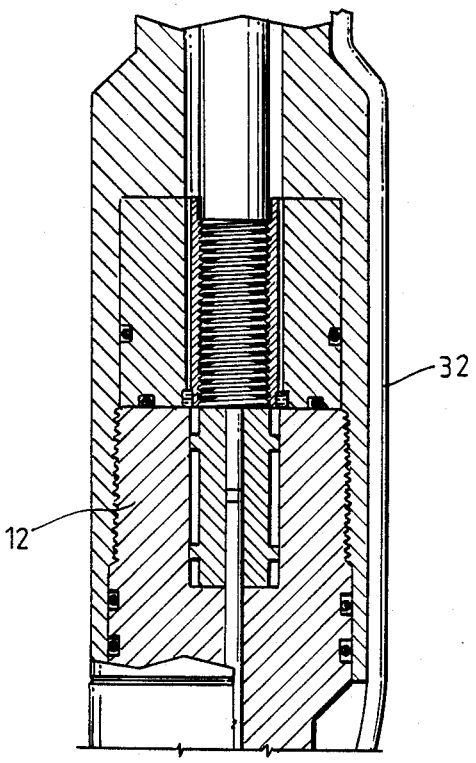
Figure 1B:
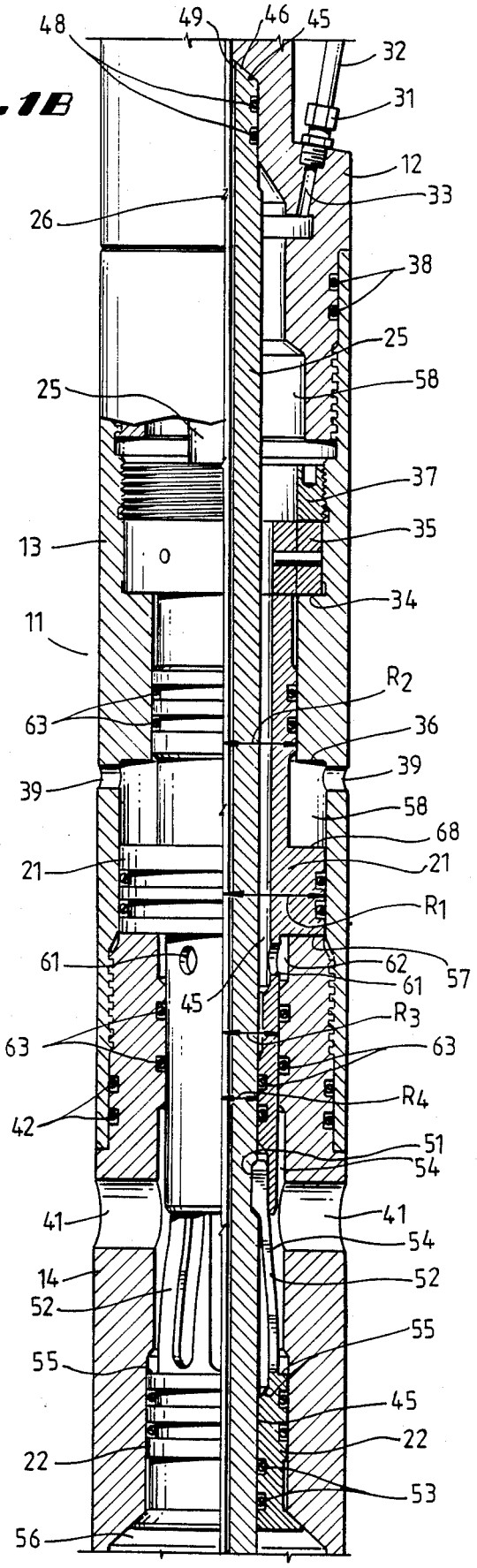

FIGS. 1A, 1B and 1C together show a section view of a firing head assembly according to the present invention. Generally, the firing head assembly includes a housing 11, an actuation piston 21, a firing piston 22, a firing pin 23 and detonator 24, a detonation cord tube 25, and two separate detonation cords 26 and 27. The first detonation cord 26 extends through the firing head by means of a straight-through longitudinal passageway through the tube 25. The second detonation cord 27 is a short cord extending from the offset firing pin 23 and detonator 24 to a point adjacent one end of the first detonation cord 26.

The housing 11 is divided into several sections. A control line inlet section 12 includes a connection 31 for the hydraulic control line 32. The generally cylindrical section 12 includes a passageway 33 extending from the control line connection 31 to the interior of the section. An actuation piston housing 13 forms a second section of the housing 11 and is also generally cylindrical. The actuation piston housing 13 includes a first shoulder 34 for engaging a shear pin set 35 and a second shoulder 36 to provide a stop to limit movement of the actuation piston 21, as will be explained more fully below. The shear pin set 35 may be held against the first shoulder 34 by means of an annular nut 37. Seals 38 are included to seal between the control line inlet housing 12 and the actuation piston housing 13 when the two are threadedly assembled. The actuation piston housing 13 includes a radially-directed port 39 for fluid communication between the interior and exterior of the housing section 13.

A firing piston section 14 of the housing 11 is also generally cylindrical in shape and includes a radially directed port 41 to provide fluid communication between the interior and exterior of the housing section 14. Seals 42 are provided to seal between the firing piston section 14 and the actuation piston section 13 when the two sections are threadedly engaged. Finally, a firing pin section 15 of the housing 11 is adapted to be threaded into the firing piston section 14. The firing pin section 15 has a bore 43 along its longitudinal axis and a separate bore 44 parallel to, but spaced apart from, its longitudinal axis. As will be explained in more detail below, this second longitudinal bore 44 is adapted to receive a firing pin 23, a detonator 24, and a detonation cord 27.

When the various sections of the housing 11 are assembled, a generally cylindrical housing having a longitudinal bore 45 therethrough is formed. A detonation cord tube 25 is received within the bore 45 and is held in place at its ends by means of upper and lower shoulders 46 and 47 in the bore. Seals 48 are provided between the detonation cord tube 25 and the bore 45 in the control line inlet section 12 of the housing 11. An annular space is formed between the detonation cord tube 25 and the housing 11. The detonation cord tube 25 is generally cylindrical, having a bore 49 along its longitudinal axis. The bore 49 receives a first, straight-through detonation cord 26 which extends from an end of the control line inlet section 12 to an end of the firing pin section 15. A circumferential groove 51 is located in the outer surface of the detonation cord tube 25.

A firing piston 22 which is generally sleeve-like is positioned within the annular space formed between the detonation cord tube 25 and the housing 11 and is longitudinally slidable therein. The piston 22 includes collet fingers 52 which may be compressed inwardly to engage the circumferential groove 51 about the detonation cord tube 25. When the fingers 52 engage the groove 51, the longitudinal movement of the firing piston 22 is prevented. Seals 53 provide a fluid seal between the firing piston 22 and the detonation cord tube 25.

A first annular region 54 is formed between the detonation cord tube 25 and the housing 11 in the region of the firing piston 22. When the firing piston 22 is in its first, unactuated position, wherein the collet fingers 52 engage the circumferential groove 51 in the detonation cord tube 25, the port 41 in the housing 11 provides fluid communication between the well bore annulus and the first annular region 54. Pressure within the well bore annulus is thus transmitted to shoulders 55 on the firing piston 22, tending to force the firing piston 22 downwardly with respect to the housing 11 and the detonation cord tube 25. The chamber 56 below the firing piston 22 is at atmospheric pressure from assembly and this atmospheric pressure will not prevent the movement of the firing piston 22 in a downward direction in response to the well bore annulus pressure.

An actuation piston 21 is generally sleeve-like and is situated within the annular space formed between the detonation cord tube 25 and the housing 11. The actuation piston 21 is longitudinally slidable within the annular space and its longitudinal movement is limited by the end 57 of the firing piston housing section 14 and the shoulder 36 in the actuation piston housing section 13. In a first, unactuated position, the actuation piston 21 engages the collet fingers 52 of the firing piston 22 and forces the fingers 52 into engagement with the circumferential groove 51 in the detonation cord tube 25. This is clearly shown in FIG. 1B. In this position, the collet fingers 52 are restrained from disengaging the circumferential groove 51 and the firing piston 22 is held in its first, unactuated position. The actuation piston 21 is held in this first position by means of a shear pin set 35. On assembly, the shear pin set 35 may be inserted into the actuation piston housing section 13 and an annular nut 37 may be used to retain the shear pin set 35 in the housing section 13.

A second annular region 58 is formed between the housing 11 and the detonation cord tube 25, in the region of the control line inlet section 12, and between the actuation piston 21 and the detonation cord tube 25, in the region of the actuation piston housing section 13. A third annular region 59 is formed between the actuation piston 21 and the housing 11 in the region of the actuation piston housing section 13 and port 39. A port 39 in the housing 11 provides fluid communication between the well bore annulus and the third annular region 59. A port 61 in the actuation piston 21 provides fluid communication between the second annular region 58 and an annular chamber 62 formed between the actuation piston 21 and the firing piston housing section 14. Seals 63 are placed in seal grooves between the actuation piston 21 and the detonation cord tube 25, between the actuation piston 21 and the firing piston housing section 14, and between the actuation piston 21 and the actuation piston housing section 13.

As can be seen in FIG. 2, the first detonation cord 26 lies along the longitudinal axis of the housing 11 and detonation cord tube 25, while the firing pin 23 is offset radially from that axis. From FIG. 3, it can easily be seen that boosters 64 and 65 for the first and second detonation cords 26 and 27, respectively, are positioned adjacent one another by means of a spool 66. The spool 66 is positioned in an end of the firing pin housing section 15 along its longitudinal axis. This positioning of the spool 66 facilitates the detonation transfer between the boosters 64 and 65 and a booster which may be located in the housing or gun section 67 located immediately below the firing pin housing section 15 in the tool string.

The operation of the apparatus is as follows:

After the perforating gun, the firing head assembly and the packer are run into the well bore on the tubing string and properly located, the packer is set in the well bore to isolate the lower annulus from the upper annulus. The packer may be tested by pressuring up the upper annulus, thus opening a tester valve. This establishes a pressure differential across the packer which, if sustained, assures that the packer is properly set. The lower annulus pressure is typically set to establish the conditions which will be desired at the time of perforation.

The hydraulic control line 32 is pressured up and this hydraulic pressure is communicated to the second annular region 58 formed between the housing 11 and the detonation cord tube 25 and between the actuation piston 21 and the detonation cord tube 25. The hydraulic fluid pressure is communicated to the annular chamber 62 by means of the port 61 in the actuation piston 21. Thus, a hydraulic fluid pressure will be exerted on the actuation piston 21, tending to force the actuation piston 21 toward its second, actuated position. The well bore annulus pressure will also exert a force on the actuation piston 21, tending to maintain the actuation piston 21 in its first, unactuated position. The annulus pressure is applied through port 39 to the third annular region 59 and through port 41 to the first annular region 54.

As seen in FIG. 4A, when a predetermined pressure differential exists between the hydraulic fluid and the well bore annulus, the shear pin set 35 will fail and the actuation piston 21 will be forced toward its second, actuated position wherein the shoulder 68 of the actuation piston 21 engages the first shoulder 36 in the actuation piston housing section 13.

The hydraulic pressure in the second annular region 58 actually exerts opposing forces, one tending to move the piston 21 toward its second, actuated position and another urging the piston 21 to remain in its first, unactuated position. Each of these forces is opposed by the well bore annulus pressure. Annulus pressure in the first annular region 54 opposes the hydraulic pressure tending to keep the piston 21 in its first position. Annulus pressure in the third annular region 59 opposes the hydraulic pressure tending to move the piston 21 toward its second position. The total force $F_1$ urging the piston 21 to remain in its first position is $$F_1 = \Delta P\,(\pi R_3^2 - \pi R_4^2),$$

where $\Delta P$ = Control line pressure − well bore annulus press, and $R_3$ and $R_4$ are the radii noted in FIG. 1B.

The total force $F_2$ urging the piston 21 toward its second position is $$F_2 = \Delta P\,(\pi R_1^2 - \pi R_2^2),$$

where $\Delta P$ = control line pressure − well bore annulus pressure and $R_1$ and $R_2$ are the radii noted in FIG. 1B.

The total force $F_T$ acting on piston 21 to cause the shear set 35 to fail is, then, given by $$F_T = F_2 - F_1.$$

Since $F_T$ must be greater than zero to actuate piston 21, then $(R_1 - R_2)$ must be greater than $(R_3 - R_4)$.

As can be seen from FIG. 4B, when the actuation piston 21 is moved to its second position, the collet fingers 52 of the firing piston 22 are released and spring outward, disengaging the circumferential groove 51 in the detonation cord tube 25. The well bore annulus pressure is transmitted to the shoulders 55 of the firing piston 22 and the firing piston 22 is forced downward to strike the firing pin 23 and detonate the detonator 24 and detonation cord 27. Prior to being struck by the firing piston 22, the firing pin 23 is held in place by means of a shear pin 71. The pin 71 fails when the firing piston 22 strikes the pin 23.

Should a failure occur in the hydraulically-actuated firing system or should well conditions preclude pressurization of the annulus, a second firing head which may be situated above the present firing head may be utilized, for example, by means of tubing pressure or a "go devil". When that is required, the first detonation cord 26 lying within the detonation cord tube 25 is utilized in place of the short detonation cord 27. Thus, redundancy is provided using a differential pressure actuated mechanism in which both the primary and the redundant detonation cords are completely enclosed and splicing is not required.

It will now be appreciated by one of ordinary skill in the art that a new and useful well bore perforating gun firing head assembly has been shown. Variations in the embodiment shown may be made without departing from the invention. Thus, the invention should be limited only by the scope of the appended claims.

What is claimed is:

1. A firing head assembly for use with a well bore perforating gun, comprising:

a generally cylindrical housing;

a first detonation cord extending through the housing, the first cord having a first detonation booster on one end;

a firing pin spaced radially from the longitudinal axis of the housing;

a firing mechanism for actuating the firing pin;

a second detonation cord for actuation by the firing pin, the second cord having a second detonation booster on one end;

a third detonation booster positioned opposite the first and second boosters;

the first and second boosters being located adjacent one another, each being positioned opposite the third booster such that each of the first and second boosters will actuate the third booster.

2. The firing head assembly of claim 1, wherein the first detonation cord extends through the housing along the longitudinal axis of the housing and wherein the second detonation cord extends from a position radially spaced from the longitudinal axis of the housing, on one end, to a position adjacent the longitudinal axis of the housing on another end.

3. The firing head of claim 1, wherein the firing mechanism includes:

a firing piston for actuating the firing pin; and an actuation piston movable from a first position, wherein the firing piston is prevented from actuating the firing pin, to a second position, wherein the firing piston is released to actuate the firing pin.

4. In a tubing-conveyed well bore perforating system wherein a well bore annulus is formed between the tubing and the well bore, a firing head assembly for use with the perforating gun, comprising:

a generally cylindrical housing;

a first detonation cord extending longitudinally through the housing;

an actuation piston longitudinally slidable within the housing and movable from a first position to a second position, the actuation piston being held in its first position by means of a shear pin;

a firing piston longitudinally slidable within the housing and movable from a first position to a second position, the firing piston being held in its first position by the actuation piston when the actuation piston is in its first position;

a firing pin and second detonation cord, the firing pin and second detonation cord being spaced radially from the longitudinal axis of the housing and being actuated by the firing piston when the firing piston moves to its second position; and a detonation booster, the booster being actuable by each of the first and second detonation cords.

5. The firing head assembly of claim 4, further comprising:

a port in the housing to provide fluid communication between the well bore annulus and the actuation and firing pistons; and a control line to provide fluid pressure to the actuation piston, the actuation piston being responsive to a predetermined pressure difference between the well bore annulus and the control line pressure to move from its first position toward its second position, and the firing piston being responsive to the well bore annulus pressure to move from its first position to its second position to actuate the firing pin and second detonation cord.

6. A firing head assembly for use with a well bore perforating gun, comprising:

a first detonation cord;

a detonation cord tube having a longitudinal bore for receiving the first detonation cord, the tube having a circumferential groove on its outer surface;

a sleeve-like firing piston for slidably receiving the detonation cord tube therethrough, the firing piston having collet fingers for engaging the circumferential groove on the tube for limiting the longitudinal movement of the piston with respect to the tube;

a sleeve-like actuation piston for slidably receiving the detonation cord tube therethrough, the actuation piston being slidable with respect to the firing piston for movement between a first position, wherein the actuation piston engages the collet fingers to hold the fingers in the circumferential groove, and a second position, wherein the actuation piston releases the collet fingers from the groove, the actuation piston forming a first annular region between the actuation piston and the detonation cord tube;

a firing pin and second detonation cord located proximate the firing piston, the firing pin serving to actuate the second detonation cord;

a cylindrical housing for receiving the detonation cord tube, the firing piston, the actuation piston and the firing pin, the firing pin being spaced radially from the longitudinal axis of the housing, the housing forming a second annular region between the housing and the detonation cord tube and a third annular region between the housing and the actuation piston;

a shear pin for engaging the housing and the actuation piston for holding the actuation piston in its first position; and a detonation booster actuable by each of the first and second detonation cords, the housing including ports to provide fluid communication between the first annular region and the well bore annulus and between the third annular region and the well bore annulus, whereby the shear pin fails and the actuation piston moves to its second position in response to a predetermined pressure differential between the first annular region and the well bore annulus, and whereby the firing piston is moved, in response to pressure in the well bore annulus, into contact with the firing pin.

* * * * *